US006794595B2

(12) United States Patent
Charles et al.

(10) Patent No.: US 6,794,595 B2
(45) Date of Patent: Sep. 21, 2004

(54) ELECTRICAL SWITCHGEAR APPARATUS COMPRISING AN ARC EXTINGUISHING CHAMBER EQUIPPED WITH DEIONIZING FINS

(75) Inventors: Richard Charles, Saint Nazaire les Eymes (FR); Stéphane Dye, Vatilieu (FR); Luc Moreau, Saint Martin le Vinoux (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/407,433

(22) Filed: Apr. 7, 2003

(65) Prior Publication Data

US 2003/0201853 A1 Oct. 30, 2003

(30) Foreign Application Priority Data

Apr. 29, 2002 (FR) ..... 02 05344

(51) Int. Cl.[7] ..... H01H 33/02
(52) U.S. Cl. ..... 218/149; 218/156
(58) Field of Search ..... 218/149, 156, 218/7, 15, 34–39, 46, 47, 262, 266–157, 29, 148, 37–43, 150–158; 335/201, 8, 10, 16, 147, 195, 202

(56) References Cited

U.S. PATENT DOCUMENTS 2,244,061 A * 6/1941 Graves ..... 218/149
4,107,497 A * 8/1978 Jencks et al. ..... 218/149
4,229,630 A * 10/1980 Wafer et al. ..... 218/149
4,247,746 A * 1/1981 Kidd ..... 218/34
4,675,481 A * 6/1987 Markowski et al. ..... 218/149
4,885,441 A * 12/1989 Hisatsune et al. ..... 218/148
5,498,847 A * 3/1996 Bennett et al. ..... 218/81
5,569,894 A * 10/1996 Uchida et al. ..... 218/27
5,589,672 A * 12/1996 Uchida et al. ..... 218/34
6,313,425 B1 * 11/2001 Doughty et al. ..... 218/149

FOREIGN PATENT DOCUMENTS

| | | |
|---|---|---|
| DE | 1792081 | 7/1959 |
| DE | 24 10 049 | 9/1975 |
| DE | 26 24 957 A1 | 11/1977 |
| DE | 43 33 278 A1 | 3/1995 |
| GB | 396871 | 8/1933 |

* cited by examiner

*Primary Examiner*—Lincoln Donovan
*Assistant Examiner*—M. Fishman
(74) *Attorney, Agent, or Firm*—Parkhurst & Wendel, L.L.P.

(57) ABSTRACT

A circuit breaker comprises a pair of separable contacts arranged in an opening volume. A plurality of flat de-ionization fins are arranged inside an arc extinguishing chamber opening out onto the opening volume. The chamber is bounded by two opposite side walls, a rear wall located away from the opening volume, a bottom wall and a top wall. Each fin has a free attack edge exposed to the arc. The free edges of the fins laterally bound a longitudinal gulley extending in a heightwise direction from the bottom electrode to the top wall, and longitudinally from a first longitudinal end opening out onto the opening volume at a second longitudinal end tapering to form a stack near to the rear wall, passing via a narrow intermediate portion. A bottom longitudinal electrode partially covers the bottom wall and extends longitudinally facing the gulley at least from the second contact up to the stack.

12 Claims, 2 Drawing Sheets

ELECTRICAL SWITCHGEAR APPARATUS COMPRISING AN ARC EXTINGUISHING CHAMBER EQUIPPED WITH DEIONIZING FINS

BACKGROUND OF THE INVENTION

The invention relates to an electrical switchgear apparatus, in particular a current limiting apparatus such as a current limiting circuit breaker, the external manifestations whereof when breaking is performed are reduced or even non-existent.

STATE OF THE ART

In the document FR 2,589,624 a conventional arc extinguishing chamber for a low-voltage power circuit breaker is described. The chamber is situated facing the separable contacts of the circuit breaker and is provided with gas outlet orifices on a rear wall opposite from the contacts. Flat metal fins are arranged inside the chamber, between the contacts and the gas outlet orifice, perpendicularly to the side walls. In the event of a short-circuit occurring, separation of the contacts gives rise to an electric arc which is projected into the chamber by an electromagnetic loop effect. As it progresses in the chamber, the arc encounters the fins which absorb a part of its energy. The arc also exchanges heat with the side walls of the chamber which are made of synthetic gas-generating material. The arc cools progressively and its voltage increases so that, when the current crosses zero, the arc is definitively extinguished. The thermal and kinetic effects of the arc plasma during breaking cause a sharp increase of the pressure in the arc extinguishing chamber. The outlet orifices enable the emitted gases to be removed and the pressure to be contained at an acceptable level inside the case of the switchgear apparatus. This removal of the partially ionized breaking gases does however impose minimum safety distances between apparatuses on any one electrical panel in order to prevent any risk of arcing between live adjacent units. It also requires arrangements to be made for overpressures so as not to damage the panel itself. Moreover, the gases outlet from the unit can be considered to be polluting and therefore have to be filtered.

Electrical switchgear apparatuses are moreover known whose case is air-tight so as to eliminate any external manifestation when breaking takes place, as described for example in the document GB 2,119,575. The case then has to be provided with high-performance sealing devices and its mechanical pressure resistance has to be increased. Air-tightness is obtained at the cost of lower breaking performances with respect to a conventional apparatus of the same volume. Furthermore, the cost of such apparatuses as compared to conventional apparatuses is very high, which results in their only being implemented under extreme conditions, for example in explosive environments.

A tightly-sealed low-voltage power circuit breaker is described in the document WO95/08832. This circuit breaker comprises an arc extinguishing chamber arranged facing the contacts and equipped with cooling fins which are arranged between the contacts and an orifice for outlet from the chamber. A recirculation channel directs the gases from the outlet of the chamber to the contact drive mechanism, passing via a de-ionizing filter. The gases emitted when breaking takes place at the level of the arc extinguishing chamber thus flow in a closed circuit in the case and are finally redirected to the contacts and to the inlet to the chamber after they have been cooled and de-ionized. This strong convection enhances high-speed displacement of the arc inside the chamber, which is considered in this document as being particularly advantageous for speeding-up breaking. The arc, as it moves in the chamber, in fact constantly encounters new cold surfaces which perform cooling of the arc. However, the size of the chamber necessary to achieve high breaking performances is thereby increased as the energy absorption capacity of the fins is not fully used due to the rapid progression of the arc. Furthermore, the recirculation channel makes the case more bulky and more complex. Finally, the arc may leave the chamber totally via the outlet opening due to the strong convection. In this case, the arc is no longer in contact with the fins and is no longer cooled.

To better use the heat exchange surface provided by the cooling fins and to prevent the arc from leaving the arc extinguishing chamber, it has been proposed, in the document DE 2,410,049, to house the fins in an enclosure made of gas-generating material, one wall whereof opposite the contacts is provided with gas outlet slits, and to fit a mask comprising holes of small diameter outside the enclosure, the mask being pressed against the wall comprising the slits. The fins are cut into a V-shape so as to form an attack slit. When the circuit breaker opens on a short-circuit current, the arc enters the chamber in centered manner. On reaching the back of the chamber, the arc is deflected onto one or the other of the sides and returns to the contacts diving up between the fins, and is then re-established between the contacts before being projected into the chamber again. The foot of the arc therefore follows a path in the form of a loop until the arcing energy has been dissipated in the fins. The fins are thus used in homogeneous manner. However, the flow of the arc gives rise to periodic restrikings of the arc on the contacts, which damage the contacts.

In the document DE 2,624,957 arc extinguishing plates are described designed for an arc extinguishing chamber of an electrical switchgear apparatus. The plates have a cut forming a tapered U or V-shaped neck extended by a slit opening out onto a circular broadened part. This shape is supposed to ensure a good localization of the arc and fast extinguishing thereof. It is scheduled to cover the extinguishing plates with a plastic or ceramic insulating material, notably polytetrafluorethylene, so as to stabilize the positioning of the arc in the circular broadened part. The plates can be made of soft iron and covered, at the level of the broadened circular part at least, with a soft and electrically insulating magnetic material to prevent the arc from forming a foot on the periphery of the broadened part. According to this teaching, the arc can be localized in the circular broadened part, but nothing is provided to perform extinguishing of the arc. In particular, the arrangements made to stabilize the arc and prevent an arc foot from forming have the consequence of the energy exchange between the arc and its environment being greatly reduced. Apparently the arc can only effectively exchange with the ridges of the plates, at the level of the circular broadened part. The lateral part of the plates is therefore not used efficiently for cooling the arc. Finally, the treatment of the plates in several layers of different materials increases the cost of the device considerably.

SUMMARY OF THE INVENTION

The object of the invention is therefore to remedy the shortcomings of the state of the art so as to be able to propose a switchgear apparatus with good performances and greatly reduced external manifestations, in a small volume.

According to the invention, this problem is solved by means of an electrical switchgear apparatus, comprising:

a case defining a longitudinal geometric reference plane and containing:

an opening volume and an arc extinguishing chamber opening out onto the opening volume and bounded by two opposite side walls parallel to the geometric reference plane, a rear wall located away from the opening volume, a bottom wall and a top wall;

a pair of separable contacts arranged in the opening volume and comprising a first movable contact movable along a flat path in the geometric reference plane between a contact position and a separated position and a second contact;

cooling fins arranged inside the arc extinguishing chamber, perpendicularly to the geometric reference plane, each fin having a free attack edge exposed to the arc;

a bottom longitudinal electrode in electrical connection with the second contact, the bottom electrode at least partially covering the bottom wall of the chamber;

wherein:

the free edges laterally bound a gulley extending in the heightwise direction from the bottom electrode to the top wall, the gulley having:

a first tapered longitudinal end opening out onto the opening volume, a second broadened longitudinal end forming a stack near the rear wall, the stack having an oblong cross-section in a plane of cross-section parallel to the fins, a narrow intermediate portion joining the first longitudinal end to the stack, the bottom electrode extending longitudinally in the gulley from the second contact to the stack at least.

The gulley and the stack enable the arc to establish itself quickly and stably at the back of the chamber, in the zone which presents an oblong shape in cross-section. It is known that in an open environment the arc naturally tends to take a general cylindrical shape of circular cross-section. The oblong shape of the stack therefore contributes to a large constriction of the arc, and therefore to a large energy exchange with the fins and the walls at this level. A gas convection current is established between the fins, laterally with respect to the gulley, and enables cooling and de-ionization of the gases to take place in contact with the fins until the arc has been extinguished. This fast cooling of the gases considerably limits the pressure increase in the chamber. The external manifestations are therefore considerably reduced or even totally eliminated. The surface of the fins is used throughout breaking and ensures a very good efficiency in the energy transfer. It should be emphasized that the flat surfaces of the fins are used more to absorb the heat of the gases emitted than to interact directly with the arc. More precisely, the arc does not seem to divide into a multiplicity of arcs drawn in series between adjacent fins.

Preferably, the fins have a given thickness and are separated two by two by a given distance which is of the same order of magnitude as said thickness. Experience shows that the small distance between fins enhances the heat exchange between the gases and the fins, in particular in the phase where the arc is localized in the stack. As an indication, the distance between fins should be comprised between 0.8 and 3 mm, and should be comprised between one half and twice the thickness of the fins. The distance between two fins designates here the smallest distance measured between the two fins, in particular when the fins are not parallel to one another. It should be noted that it is the architecture of the circuit breaker, and in particular the presence of the gulley fostering insertion of the electric arc, which enables the fins to be arranged a short distance from one another. Conventionally in the state of the art, the space between fins is always at least 20% larger than the thickness of the fins, whereas according to the invention considerably smaller distances can be achieved.

Preferably, the stack is limited to the rear by the rear wall. This arrangement favors constriction of the foot of the arc, voltage increase of the arc and pressure limiting in the chamber.

Preferably, the rear wall is not provided with any gas outlet orifices. Flow of the gases between the fins is thus enhanced, thus enhancing use of the whole surface of the fins as heat exchange surface.

According to a particularly advantageous embodiment, the chamber and opening volume together form a closed breaking volume. The arrangement of the chamber enables the pressure increase to be controlled, and therefore enables the chamber to be closed without a major risk of explosion of the apparatus. Alternatively, and for apparatuses of very small volume, it may be preferable to provide at least one calibrated outlet orifice or a pressure relief valve to limit the overpressure in the chamber.

According to one embodiment, the longitudinal bottom electrode is separated from the fins by a distance which is the same order of magnitude as the thickness of the fins. This arrangement enables a large constriction of the foot of the arc to be achieved. Preferably, the lateral volume between the bottom wall and the fins, on at least one of the sides of the bottom electrode, is limited by walls which also contribute to constricting the arc.

Preferably each fin is provided with at least one lateral fixing tab secured in a slit of the side walls, and with at least one rear fixing tab secured in a slit of the rear wall. The rear tab provides a solution to the problem of fixing of the fin and enables the possible mechanical weakness due to the presence of the stack to be compensated.

According to one embodiment, the fins are parallel to one another.

According to one embodiment of the invention, the rear wall is inclined with respect to the fins. This arrangement tends to stabilize the arc at the back of the chamber and to increase the length of the arc.

According to one embodiment of the invention, the gulley extends appreciably in the geometric reference plane, at equal distance from the side walls of the chamber. This arrangement should be preferred for high performances and when the side walls of the chamber have to be prevented from deteriorating too quickly. The gulley in fact constitutes a privileged path for the arc which is thus centered during its displacement to the stack.

According to another alternative, the narrow intermediate part of the gulley is located closer to one of the side walls moving away from the opening volume. This arrangement constitutes an interesting compromise to optimize the dimensions of the chamber. The contacts are located in a mid-plane of the chamber, mid-way between the side walls of the chamber, which enables the opening volume to be optimized. The gulley penetrates obliquely into the chamber. The narrowest fins are used above all for their constricting effect when insertion of the arc takes place. The broadest fins are for their part also used to cool the gases once the arc has established itself in the stack.

Preferably, the switchgear apparatus is a limiting circuit breaker comprising rigid input conductors for conveying current to the contacts, these rigid conductors being shaped in such a way that, when a current flows therethrough, they generate an intense electromagnetic field near the contacts, such as to cause electromagnetic repulsion of the movable contact to the separated position and to project the electric arc into the chamber. Typically, the stationary contact is supported by a U-shaped conductor. Other shapes amply described in the state of the art can however be envisaged. Projection of the arc enables the latter to reach the stack rapidly.

BRIEF DESCRIPTION OF THE FIGURES

Other advantages and features will become more clearly apparent from the following description of particular embodiments of the invention given as non-restrictive examples only and represented in the accompanying drawings in which.

DETAILED DESCRIPTION OF DIFFERENT EMBODIMENTS

Figure 1:
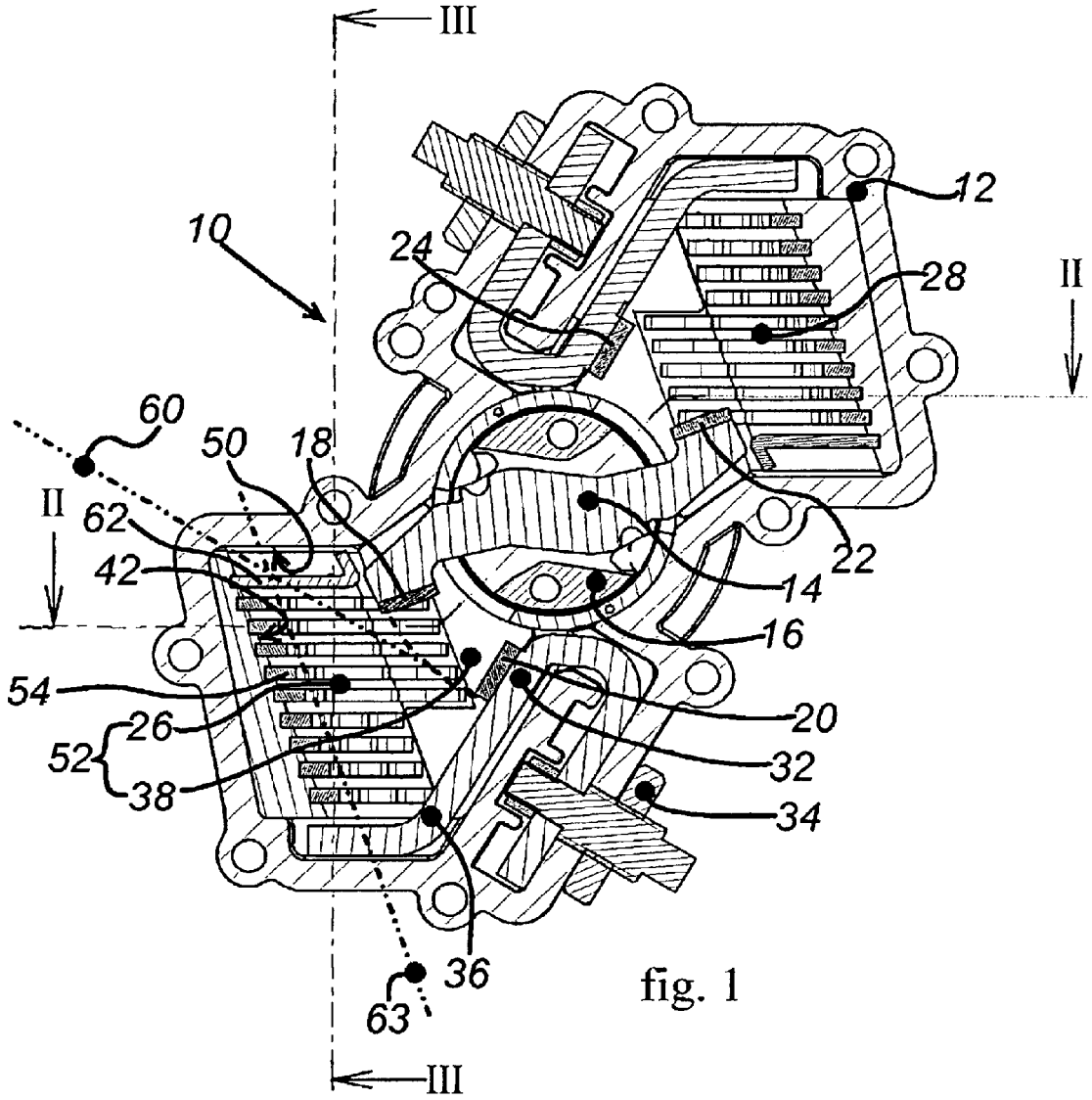
FIG. 1 represents a switchgear apparatus according to a first embodiment of the invention, seen in cross-section along a plane I—I.
Figure 2:
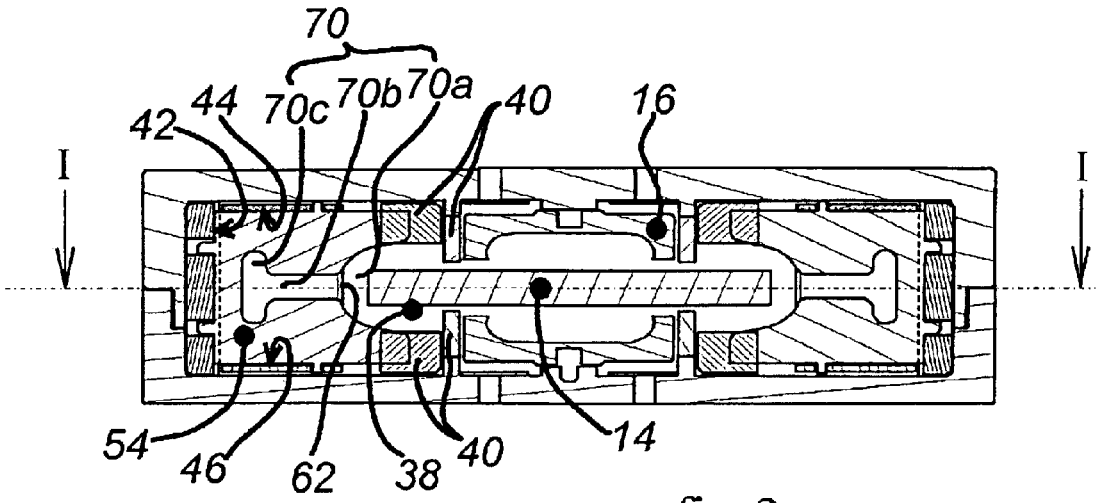
FIG. 2 represents a detail of the switchgear apparatus of FIG. 1, in cross-section along a plane II—II.
Figure 3:
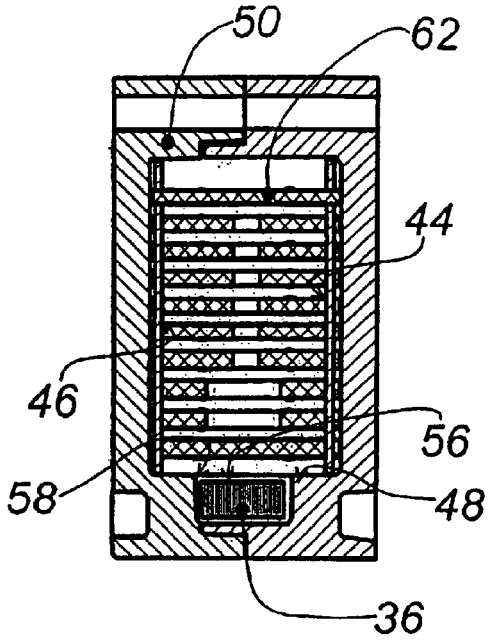
FIG. 3 represents a detail of the switchgear apparatus of FIG. 1, in cross-section along a plane III—III.
Figure 4:
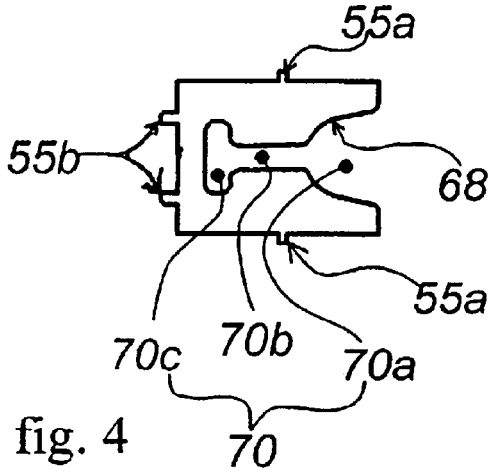
FIG. 4 represents a fin of the switchgear apparatus of FIG. 1.

With reference to FIGS. 1 to 3, a low-voltage molded case power limiting circuit breaker comprises one or more breaking pole-units. The pole-unit 10 represented in FIG. 1 comprises a case made of molded plastic material 12 housing a rotary contact bridge 14 supported by a section of shaft 16 extending perpendicularly to the plane of FIG. 1. The shaft 16 is driven by a drive mechanism known as such, as described for example in the document FR 2,589,624. The contact bridge 14 comprises a first movable contact 18 operating in conjunction with a first stationary contact 20, and a second movable contact 22 operating in conjunction with a second stationary contact 24. Each pair of contacts 18, 20, resp. 22, 24 has an arc extinguishing chamber 26, resp. 28 associated thereto. The construction of the pole-unit 10 being symmetrical with respect to the axis of rotation of the switching shaft 16, only the half of the pole-unit associated with the contacts 18, 20 and the chamber 26 will be described in detail here.

The stationary contact 20 is fixed on a contact member 32 formed by a U-shaped metal part, one end whereof is connected to a connecting strip 34 and the other end whereof forms a bottom electrode 36 extending inside the chamber.

The contact 18 is movable between a separated position represented in FIG. 1 and a contact position in contact with the stationary contact 20. The separation movement of the contact 18 is a flat movement, in the sense that the path followed by the contact is parallel to the cross-sectional plane I—I of FIG. 1. The path covered by the movable contact 18 between its two extreme positions defines an opening volume 38 which is closed on the side opposite the arc extinguishing chamber 26 by the section of shaft 16, and restrained laterally by partitioning parts 40.

The arc extinguishing chamber 26 is bounded by a rear wall 42 opposite the opening volume 38, a bottom wall 48 and a top wall 50, formed by walls of the case, and two flat side walls 44, 46 formed by plates made of insulating material pressed onto a wall of the case. The chamber 26 opens out onto the opening volume 38. The breaking volume 52 formed by the arc extinguishing chamber 26 and by the opening volume 38 is closed, in the sense that it is not provided with any channel or orifice for deliberate outlet of the breaking gases. However, no particular arrangement is made to prevent possible leaks from occurring via the joining lines of the different parts of the molded case. The breaking volume 52 is therefore a sealed volume, the air-tightness whereof is however imperfect. The air-tightness does however have to be sufficient for the gas leakages not to disturb the required flow in the breaking volume. For indication purposes, the air-tightness is similar to that defined by the Ip54 code according to the IEC 60529 standard: "volume protected against water projections in all directions and against dust (no harmful deposit)".

The chamber contains flat metal fins 54 arranged parallel to one another and perpendicularly to the side walls 44, 46. The gap between two fins is small, about the thickness of the fins. Each fin is provided with two lateral positioning tabs 55*a* for positioning and securing, sunk in the side walls 44,46, and with two rear tabs 55*b*. Each fin has its rear edge fully inserted in a groove of the rear wall to prevent flows of gas, and the rear tabs 55*b* are sunk by force in deeper recesses of the rear wall to provide the mechanical strength. The side edges of the fins are pressed against the side walls so as not to leave any significant clearance between walls and fins.

The bottom wall 48 of the chamber comprises a groove 56 wherein the bottom electrode 36 is sunk, as shown in detail in FIG. 3. The edges 58 of the groove are salient with respect to the electrode 36 towards the inside of the chamber 26. On the sides of the groove 56, the bottom wall 48 is raised so as to reduce the space separating the bottom wall 48 from the nearest fin 54. The distance between the bottom electrode 36 and the nearest fin is of the same order of magnitude as the gap between two fins.

If the direction 60 of the tangent to the circular trajectory of the movable contact at the time separation of the contacts takes place is taken as geometric reference, it can be observed that the fins 54 are arranged in oblique geometric planes with respect to this reference direction 60, making an angle of about 30 to 50° with this reference direction 60. The electrode 36 formed by the stationary contact member 32 comprises an end part arranged in a manner appreciably parallel to the fins, perpendicularly to the cross-sectional plane III—III inside the chamber, and an intermediate part arranged appreciably perpendicularly to the reference direction 60. The rear wall 42 is for its part inclined with respect to the reference direction 60, but also with respect to a cross-sectional plane III—III. The incline of the rear wall 42 is intermediate between the direction 60 and the plane III—III.

Preferably, the chamber also comprises in its upper part a sunken top electrode 62 covering a large part of the top wall 50. Unlike the bottom electrode, the top electrode is not electrically connected to one of the contacts.

As illustrated in FIGS. 1–4, the fins 54 each have a ridge 69 forming a cut defining two wings on each side of a gulley 70. The gulleys of a plurality of fins 54 extend in the heightwise direction from the bottom wall 48 and the bottom electrode 36 up to the top wall 50 and the top electrode 62. Each gulley 70 comprises a tapered front part 70*a* facing the contacts. It comprises a narrow longitudinal portion 70*b* followed by a broadening 70*c* on the opposite side from the contacts, near to the rear partition of the arc extinguishing chamber. The gulleys of a plurality of fins 54 together form a stack or stack chamber between the bottom wall 48 and the bottom electrode 36 on the one hand and the top wall 50 and the top electrode 62 on the other hand. The bottom electrode 36 and the top electrode 62—or the top wall 50 if there is no top electrode—are thus directly facing one another on each side of the gulley. The broadening portion 70*c* is oblong, i.e. its width, measured in a direction perpendicular to the longitudinal geometric mid-plane is larger than its depth, measured in a cross-sectional plane parallel to any one of the fins 54. The stack is inclined appreciably parallel to the rear wall, in a direction 63.

The switchgear apparatus operates in the following manner. When a short-circuit occurs, the electromagnetic field induced by the current flowing in the conductors and in particular in the U-shaped stationary contact member 32 generates electrodynamic forces in the movable contact member 14 which repel the movable contact violently to the separated position, this movement being subsequently confirmed by opening of the drive mechanism of the shaft 16. As soon as separation of the contacts 18, 20 has taken place, an arc electric arises between the contacts 18, 20. This arc is projected into the chamber by the electrodynamic forces induced by the electromagnetic field. During its displacement to the rear wall 42 and the stack 70*c*, the arc remains mid-way between the side walls 44, 46, as it tends to take the open gulley 70*b* between the fins. A gas convection is established from the rear wall 42 to the pre-chamber 38 running along the side walls 44, 46 of the chamber so that the progression of the arc to the rear wall 42 is not hindered by a pressure increase. The foot of the arc migrates rapidly along the bottom electrode 36 to the stack 70*c* even before the movable contact 18 has reached its final separated position. During its displacement, the foot of the arc attacks the edges 58 of the groove 56 which generate gas, causing a constriction of the foot of the arc. The gap between the bottom wall 48 and the fins 54 is small, so that the bottom part of the plasma column forming the arc is confined between the bottom electrode and the nearest fin, which further enhances constriction of the arc. This constriction fosters a rapid increase of the arcing voltage and a correlative reduction of the current intensity. Paradoxically, the lack of a gap between the bottom wall 48 and the first fin 54, on the lateral sides of the groove 56, contributes to stabilizing and even reducing the pressure prevailing in the chamber, enhancing limiting of the current intensity.

The head of the arc remains during a first stage at the salient end of the movable contact member 14. Due to the incline of the fins 54, the arc embraces a large number of fins right from the beginning of opening, which is favorable to a large heat exchange.

When the movable contact bridge 14 reaches its extreme separated position, the foot of the arc is at the end of the bottom electrode 36, at the bottom of the stack. The arc curves further so as to move up the stack 70*c* from the end of the bottom electrode 36 to the end of the top electrode 62, and then runs along the top electrode 62 which forms an equipotential surface up to the salient end of the movable contact member 14 in the separated position. In certain cases, the arc even divides into two arcs in series: a long arc between the bottom electrode 36 and the top electrode 62 and a short arc between the top electrode 62 and the movable contact member 18. In this case, the head of the long arc migrates almost instantaneously to the back of the chamber. In all cases, the arc is stably established in the stack 70*c* until it is extinguished. This position of the arc fosters lateral gas flow in the chamber from the stack to the opening volume, i.e. flowing between the fins 54, along the side walls 44, 46. By flowing in this way, the gas cools quickly by heat exchange with the fins and the side walls of the chamber and contracts. Except for possible leakages through the joins between the parts of the case, the gas cannot find any outlet from the breaking volume 52.

The fins 54 provide the arc with a heat exchange surface throughout breaking, in particular in their part near the ridges 66. The arc, both when it is progressing in the chamber and when it is established in the stack, tends to dilate to invade all the available space. The fins 54 contain this dilatation by interacting with the periphery of the arc.

The arcing voltage increases as the arc cools and the pressure increases in the breaking volume, which finally enables the arc to be extinguished when a current zero crossing occurs.

The narrow middle part 70*b* of the gulley 70 enhances migration of the arc to the back of the chamber, and the a tack stabilizes the arc in this region. Comparative tests do in fact show that if a stack is provided at the back of the chamber without an intermediate gulley, the arc does not always reach the stack, and that inversely, if there is a gulley without a stack, the arc is not established at the back of the gulley so that repeated arc breakdowns occur between the contacts. It is therefore the combination of the narrow intermediate part 70*b* of the gulley and of the stack which enables the arc to be moved quickly and lastingly away from the contacts.

Figure 5:
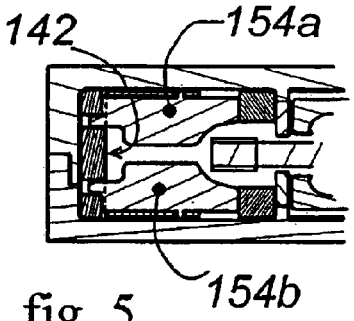
FIG. 5 represents a schematic view of a switchgear apparatus according to a second embodiment of the invention.

FIG. 5 illustrates a second embodiment of the invention, in which each of the flat fins of the first embodiment is replaced by two side fins 154*a*, 154*b*. Each side fin is then provided with a tab for securing in the rear wall and with a tab for securing in the side wall. This variant simplifies manufacturing of the fins and enables the fins to be fitted staggered if required.

A particular difficulty is encountered with the symmetrical architecture of the previous embodiments when it is sought to reduce the width of the chamber, i.e. the distance between the side walls of the chamber. When the gulley is arranged mid-way from the side walls in a narrow chamber, the required gas flow is not obtained. The dimension of the fins is in fact then small which means that the side walls play a paramount role in gas outflow. This undesirable effect is felt in particular once the arc has established itself in the stack and projects gases to the opening volume. It is then observed that the gases have difficulty penetrating between the fins and tend to take the gulley directly, and that they consequently do not encounter any heat exchange surface enabling them to be cooled.

Figure 6:
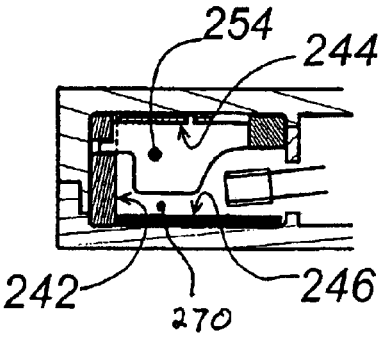
FIG. 6 represents a schematic view of a switchgear apparatus according to a third embodiment of the invention.

A third embodiment of the invention, illustrated in FIG. 6, was therefore specifically developed for an apparatus of small width equipped with a narrow arc extinguishing chamber. The gulley 270 runs directly along one of the side walls 246 and is bounded on the opposite lateral side by fins 254 pressed against the side wall 244. The width of the fins, measured between the gulley 270 and the wall 244, is then sufficient for the side walls not to significantly hinder penetration of the gases between the fins 254. Tests show that the gases do actually penetrate between the fins 254 and are cooled there. However, direct exposure of the wall 246 to the arc makes this device delicate to master and imposes a non gas-generating wall with a good heating capacity, for example made of porous ceramic.

Figure 7:
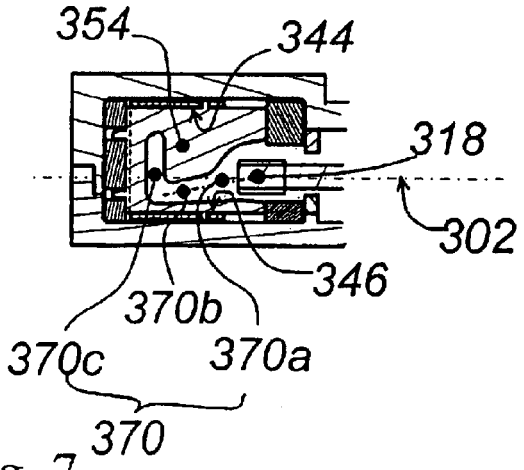
FIG. 7 represents a schematic view of a switchgear apparatus according to a fourth embodiment of the invention.

A fourth embodiment of the invention, also developed for narrow chambers, is illustrated in FIG. 7 and solves this residual problem. In the figure, the reference signs used in the first embodiment have been used as far as possible for parts corresponding to similar parts of the first embodiment, with the FIG. 3 added in front. To describe this embodiment in detail, a mid-plane 302 of the chamber, situated mid-way from the side walls 344, 346 of the chamber, will be taken as geometric reference. The contacts 318 are situated offset laterally with respect to the mid-plane 302. The separators 354 are cut so as to define a gulley 370 comprising a mouth 370*a*, a middle part 370*b* and a bend part 370*c*. The middle part 370*b* extends obliquely with respect to the mid-plane. Thus, the gulley 370 is moved to be located closer to one of the side wall moving away from the opening volume 338. Between the middle part of the gulley 370*b* and the wall 344, the fins are of small width, whereas on the other side of the gulley 370*b* the fins are of larger width. This phenomenon becomes accentuated when approaching the back the chamber. The bend part is formed in this embodiment by a bend of the gulley. Penetration of the arc in the gulley 370 is not hindered by the particular arrangement of the gulley, as the latter remains in a radial plane with respect to the geometric reference axis. The side walls 344, 346 of the chamber are sufficiently protected from the arc due to the interposition of the fins 354, even on the side where the latter are narrower. Once the bend 370*c* has been reached, the arc establishes itself in the stack and remains there. The gases emitted at the periphery of the arc are then situated between the gulley 370*b* and the wall 346 of the wide fins which perform efficient cooling and which also enable a sufficient outflow. This arrangement provides the advantage over the embodiment of FIG. 6 of protecting the side wall 344 of the chamber situated on the side where the narrow fins are located, without however hindering the gas flow.

Naturally, various other modifications are possible.

The top electrode can be omitted in certain cases.

The fins are preferably parallel to one another, which is favorable to a homogeneous gas flow and a continuous heat exchange with the whole surface of the fins. Other arrangements can however be envisaged.

The angle of incline of the fins with respect to the reference direction can be more or less great, between 0 and 90°, in typical manner between 30 and 60°. It can be noted that a strong incline favors the voltage increase of the arc at the beginning of opening, no doubt due to the fact that at the beginning of opening the foot of the arc is rapidly projected towards the free end of the electrode by the electromagnetic effect of the U-shaped contact member, so that the arc is itself inclined and can embrace a larger number of fins if the latter are themselves inclined.

The flow of the gases laterally from the stack to the pre-chamber can be enhanced by fitting intermediate insulating partitions parallel to the side walls and confining with the latter lateral channels on each side of the central gulley.

The invention applies both to a pole-unit with double breaking, having a movable contact bridge and two arc extinguishing chambers per pole-unit, and to a pole-unit comprising a single arc extinguishing chamber per pole-unit. The movable contact can be rotary or movable in translation.

The stationary contact 20 can be replaced by a movable contact driven by the drive mechanism of the contacts in opposition with the contact 22, or by a semi-movable contact driven by a contact pressure spring.

Although the invention finds its major application in air-tight arc extinguishing chambers, it is also applicable to arc extinguishing chambers equipped with a gas outlet orifice. In this case, it appears preferable to prevent any outlet close to the bottom of the stack and to the bottom electrode. Outlet via the top of the stack near the top electrode or via holes made in the top electrode is possible.

What is claimed is:

1. An electrical switchgear apparatus, comprising:

a case defining a longitudinal geometric reference plane and containing:

an opening volume having an aperture ; and an arc extinguishing chamber communicating through the aperture with the opening volume and bounded by two opposite side walls parallel to the longitudinal geometric reference plane, a rear wall located opposite the aperture, a bottom wall and a top wall;

a pair of separable contacts located in the opening volume and comprising a first movable contact movable along a flat path in the longitudinal geometric reference plane between a contact position and a separated position, and a second contact;

a plurality of cooling fins located inside the arc extinguishing chamber and oriented perpendicular to the longitudinal geometric reference plane, each fin having a free edge for exposure to an arc;

a bottom longitudinal electrode in electrical connection with the second contact, the bottom electrode at least partially covering the bottom wall of the arc extinguishing chamber; wherein:

the free edges of the plurality of cooling fins collectively define a stack chamber extending in a direction from the bottom electrode to the top wall, the free edges defining the cross sectional shape of the stack chamber wherein the free edges of each fin include:

a first tapered longitudinal portion communicating through the aperture with the opening volume, a second broadened longitudinal portion adjacent the rear wall, the second longitudinal portion having an oblong cross-section in a plane of cross-section parallel to the fins, a narrow intermediate portion joining the first longitudinal portion to the second longitudinal portion, wherein the stack chamber is also defined by the bottom electrode and the top wall.

2. The apparatus according to claim 1, wherein the fins each have a thickness and are separated from each other by a distance that is of the same order of magnitude as said thickness.

3. The apparatus according to claim 1, wherein a size of the stack chamber is limited by location of the rear wall.

4. The apparatus according to claim 1, wherein the rear wall does not comprise gas outlet orifices.

5. The apparatus according to claim 1, wherein the arc extinguishing chamber and the opening volume together define a closed breaking volume.

6. The apparatus according to claim 1, wherein the longitudinal bottom electrode is separated from the fins by a distance that is the same order of magnitude as a thickness of the fins.

7. The apparatus according to claim 1, wherein each fin comprises at least one lateral fixing tab in a slit of the side walls, and at least one rear fixing tab in a slit of the rear wall.

8. The apparatus according to claim 1, wherein the fins are parallel to one another.

9. The apparatus according to claim 8, wherein the rear wall is inclined with respect to the fins.

10. The apparatus according to claim 1, wherein the stack chamber is equally distant from the side walls of the chamber.

11. The apparatus according to claim 1, wherein the narrow intermediate portion of the stack chamber, defines a gap adjacent one of the side walls, which gap narrows in width in a direction moving away from the opening volume.

12. The apparatus according to claim 1, wherein the apparatus is a limiting circuit breaker comprising rigid input conductors for conveying current to the contacts, said rigid conductors having a shape such that, when a current flows therethrough, said conductors are for generating an intense electromagnetic field near the contacts, thereby causing electromagnetic repulsion of the movable contact to the separated position for projecting an electric arc into the arc extinguishing chamber.

* * * * *